US007432435B2

(12) United States Patent
Tamura et al.

(10) Patent No.: US 7,432,435 B2
(45) Date of Patent: Oct. 7, 2008

(54) TONE SYNTHESIS APPARATUS AND METHOD

(75) Inventors: Motoichi Tamura, Hamamatsu (JP); Yasuyuki Umeyama, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 0 days.

(21) Appl. No.: 11/788,553

(22) Filed: Apr. 19, 2007

(65) Prior Publication Data

US 2007/0256542 A1 Nov. 8, 2007

(30) Foreign Application Priority Data

Apr. 25, 2006 (JP) ..... 2006-120530

(51) Int. Cl.
*G10H 1/06* (2006.01)
*G10H 7/00* (2006.01)

(52) U.S. Cl. ..... 84/622; 84/602; 84/604; 84/625; 84/626

(58) Field of Classification Search ..... None
See application file for complete search history.

(56) References Cited

U.S. PATENT DOCUMENTS 5,559,298 A 9/1996 Okamoto
5,672,836 A * 9/1997 Yoshida ..... 84/607
6,150,598 A 11/2000 Suzuki et al.
6,255,576 B1 7/2001 Suzuki et al.
6,933,838 B2 * 8/2005 Yamaki et al. ..... 340/475
2006/0213356 A1 * 9/2006 Nakazono et al. ..... 84/645
2006/0272482 A1 * 12/2006 Tamura et al. ..... 84/604
2007/0000371 A1 * 1/2007 Akazawa ..... 84/604

FOREIGN PATENT DOCUMENTS

EP 1 729 283 12/2006
EP 1 742 200 1/2007

* cited by examiner

*Primary Examiner*—Marlon T Fletcher
(74) *Attorney, Agent, or Firm*—Morrison & Foerster LLP

(57) ABSTRACT

Dynamics value is acquired intermittently at predetermined time periods, and a waveform data set for a sustain tone, corresponding to the acquired dynamics value, is specified from among waveform data sets stored in a memory. To generate a tone waveform while switching to the specified waveform, a waveform switching time is used which is modified suitably in accordance with a dynamics value variation amount from a predetermined time earlier than the current dynamics value acquisition time to the current dynamics value acquisition time. Such arrangements not only can variably control a tone, having a tone-color-variation realizing characteristic, in accordance with the input dynamics value but also permits a tone color variation with an enhanced responsiveness without causing the tone color variation to impart a feeing of undesired step-like unsmoothness, thereby synthesizing a tone with a high quality faithfully reproducing a desired tone color variation.

14 Claims, 5 Drawing Sheets

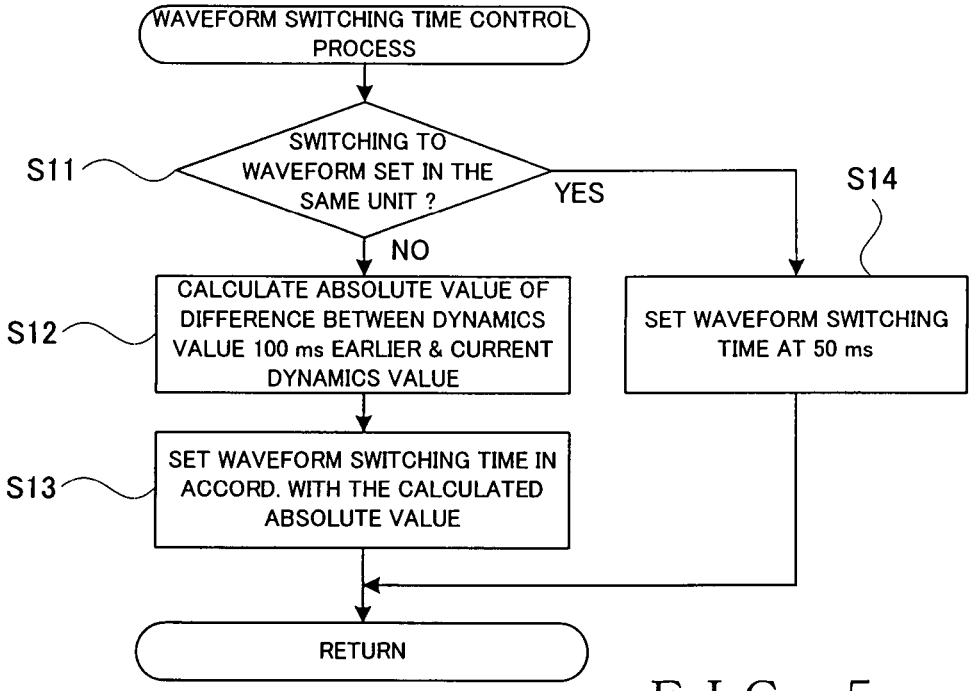
F I G. 5
| ΔD | WAVEFORM SWITCHING TIME |
|---|---|
| 5dB OR OVER | 10ms |
| 1-5 dB | 50ms |
| LESS THAN 1dB | 200ms |
F I G. 6
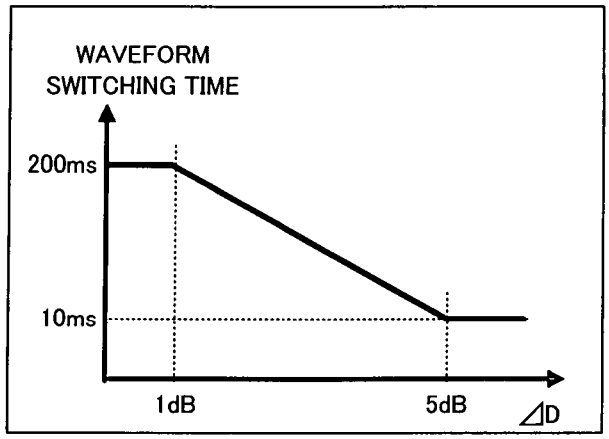
F I G. 7

TONE SYNTHESIS APPARATUS AND METHOD

BACKGROUND OF THE INVENTION

The present invention relates generally to tone synthesis apparatus and methods for synthesizing tones, voices or other desired sounds on the basis of waveform sample data stored in a waveform memory or the like. More particularly, the present invention relates to a tone synthesis apparatus and method for synthesizing a waveform of a sustain portion of a tone, where generation of the tone lasts in a relatively stable manner, while variably controlling a waveform-switching time (so-called "crossfade time period").

There have been known tone synthesis apparatus which can synthesize a vibrato rendition style waveform with a high quality for a plurality of vibrato cycles. For that purpose, the tone synthesis apparatus discretely extract a plurality of waveforms (i.e., partial waveforms) from vibrato-modulated (pitch-modulated) continuous waveforms of one vibrato cycle range sampled on the basis of actual performances of natural musical instruments, and stores the thus-extracted waveforms as template waveforms. In reproduction of a tone, the tone synthesis apparatus repetitively read out the stored template waveforms while switching between the template waveforms in accordance with a predetermined sequence, to thereby synthesize a high-quality vibrato rendition style waveform for a plurality of vibrato cycles. One example of such tone synthesis apparatus is disclosed in Japanese Patent Publication No. 3669177 corresponding to U.S. Pat. No. 6,150,598. The tone synthesis apparatus disclosed in the No. 3669177 patent publication is arranged so that, when switching is to be effected between template waveforms, the adjoining template waveforms are subjected to crossfade synthesis for a predetermined waveform switching time (so-called "crossfade time period").

However, the conventionally-known tone synthesis apparatus permitting high-quality tone synthesis, like the one disclosed in the No. 3669177 patent publication, are arranged to only read out the template waveforms in accordance with the predetermined sequence; namely, the conventionally-known tone synthesis apparatus are not arranged to change characteristics of the tone as desired in accordance with dynamics information (tone volume level information), pitch bend information (pitch modulation information), etc. input as needed during synthesis of the tone. Further, in the conventionally-known tone synthesis apparatus, the above-mentioned crossfade time period, over which crossfade synthesis is to be performed, is empirically set at a predetermined reference time (e.g., 50 ms (milliseconds)) as a balanced crossfade time well reflecting a tone color variation, and thus, a crossfade time period optimal to each individual waveform switching can not be set in accordance with information triggering tone-color-change-involving waveform switching, such as dynamics information and pitch bend information input as needed during tone synthesis. Thus, if there has occurred a sudden variation in the input dynamics value, such as in a change from "sforzando" to "piano", the waveform switching would be undesirably delayed. Namely, the tone color variation may not sufficiently follow the input dynamics value variation, which is very disadvantageous. Conversely, if the input dynamics value has varied slowly, the waveform switching would be completed earlier than initially intended, so that there would arise a stepwise tone color variation in a portion in question. Such a stepwise tone color variation would catch user's attention and tends to be offensive to the ear of the user.

SUMMARY OF THE INVENTION

In view of the foregoing, it is an object of the present invention to provide an improved tone synthesis apparatus and method which, in synthesizing a high-quality tone waveform according to a rendition style involving a timewise tone color variation in a sustain portion of a tone, can not only variably control characteristics of the tone in accordance with input dynamics information and input pitch bend information but also dynamically set a waveform switching time optimal to each individual waveform transition.

In order to achieve the above-mentioned object, the present invention provides an improved tone synthesis apparatus, which comprises: a storage section that stores therein a plurality of waveforms for sustain tones in association with dynamics values; an acquisition section that, when a sustain tone is to be generated, acquires, in accordance with passage of time, a dynamics value for controlling a volume of the sustain tone to be generated; a waveform selection section that selects a waveform, corresponding to the acquired dynamics value, from among the waveforms stored in the storage section; a tone signal synthesis section that synthesizes a tone signal using the waveform selected from the storage section in correspondence with the acquired dynamics value, the tone signal synthesis section performing crossfade synthesis between the waveforms successively selected from the storage section; and a determination section that determines a variation amount over time of the acquired dynamics value and variably sets, in accordance with the variation amount, a waveform switching time over which the crossfade synthesis is to be performed.

According to the present invention, a dynamics value is acquired in accordance with the passage of time (e.g., intermittently at predetermined time intervals), and a waveform data set for a sustain tone, corresponding to the acquired dynamics value, is selected from the storage section. In the storage section, a plurality of waveforms for sustain tones are stored in association with various dynamics values. To generate a tone waveform while performing crossfade synthesis between successively-selected waveforms in such a manner that smooth switching can be effected from the preceding one of the successively-selected waveforms to the succeeding waveform, a variation amount of the acquired dynamics value is determined, and a waveform switching time, over which the crossfade synthesis is to be performed, is set in accordance with the variation amount. For example, there is used a waveform switching time which is modified suitably in accordance with a dynamics value variation amount in a period from a predetermined time earlier than the current dynamics value acquisition time to the current dynamics value acquisition time. With the aforementioned arrangements that a waveform data set to be used to realize a tone color variation is specified, from among the plurality of waveform data sets prestored in the storage section, in accordance with the dynamics value acquired intermittently at predetermined time intervals and the waveform switching time is modified suitably, on the basis of the dynamics value variation amount, to synthesize a tone, the present invention not only can variably control a tone characteristic in accordance with the input dynamics value but also permits a tone color variation with an enhanced responsiveness (follow-up capability) without causing the tone color variation to impart a feeing of undesired step-like unsmoothness, thereby synthesizing a tone with a high quality faithfully reproducing a desired timewise tone color variation.

According to a second aspect of the present invention, the present invention provides an improved tone synthesis apparatus, which comprises: a storage section that stores therein a plurality of units, each including a plurality of waveforms corresponding to different pitches, in association with dynamics values; an acquisition section that acquires, in accordance with passage of time, a dynamics value for controlling a tone to be generated and pitch information for controlling a pitch of the tone to be generated; a waveform selection section that selects a unit, corresponding to the acquired dynamics value, from among the units stored in the storage section and selects a waveform, corresponding to the acquired pitch information, from among the waveforms included in the selected unit; a tone signal synthesis section that synthesizes a tone signal using the waveform selected from the storage section in correspondence with the acquired dynamics value and pitch information, the tone signal synthesis section performing crossfade synthesis between the waveforms successively selected from the storage section; and a determination section that determines variation amounts over time of at least one of the acquired dynamics value and pitch information and variably sets, in accordance with the variation amounts, a waveform switching time over which the crossfade synthesis is to be performed.

With the aforementioned arrangements that a waveform data set to be used to realize a tone color variation is selected, from among the plurality of waveform data sets prestored in the storage section, in accordance with the dynamics value and pitch information acquired intermittently at predetermined time intervals and the waveform switching time, pertaining to a tone color variation, is modified suitably, on the basis of the dynamics value variation amount or pitch variation amount, to synthesize a tone, the present invention not only can variably control a tone characteristic more finely in accordance with the input dynamics value and pitch information but also permits a tone color variation with an enhanced responsiveness (follow-up capability) without causing the tone color variation to impart a feeing of undesired step-like unsmoothness, thereby synthesizing a tone with a high quality faithfully reproducing a desired timewise tone color variation.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which:

FIG. 5 is a flow chart showing an example operational sequence of a waveform switching time control process;

FIG. 6 is a diagram showing an example of a table to be referenced in determining a waveform switching time on the basis of a dynamics value variation amount;

FIG. 7 is a conceptual diagram schematically showing continuous relationship between the waveform switching time and the dynamics value variation amount;

FIG. 8 is a diagram explanatory of selection of a unit and waveform data set, of which FIG. 9 shows example time-serial combinations of waveform data sets selected in accordance with the input dynamics values and pitch bend values, of which

DETAILED DESCRIPTION OF THE INVENTION

Figure 1:
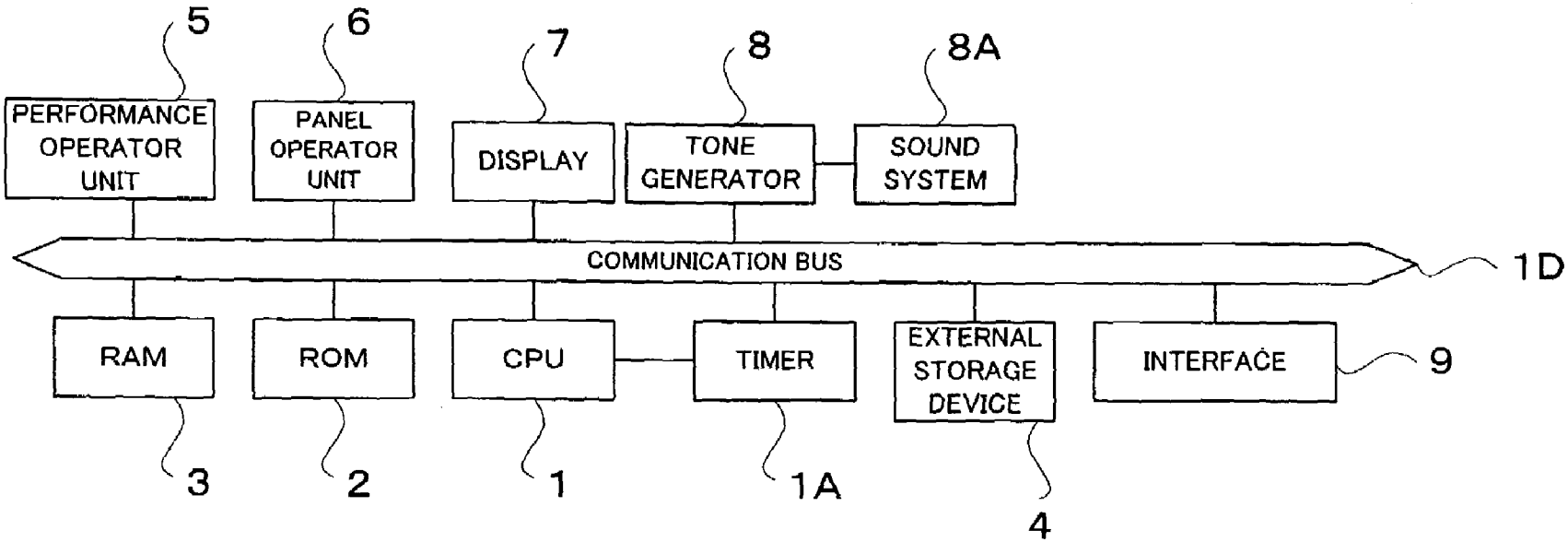
FIG. 1 is a block diagram showing an exemplary general hardware setup of an electronic musical instrument to which is applied a tone synthesis apparatus in accordance with an embodiment of the present invention.

FIG. 1 is a block diagram showing an exemplary general hardware setup of an electronic musical instrument to which is applied a tone synthesis apparatus in accordance with an embodiment of the present invention. The electronic musical instrument illustrated here has a tone synthesis function for electronically generating tones on the basis of performance information (e.g., performance event data, such as note-on event and note-off event data, and various control data, such as dynamics information and pitch information) supplied in accordance with a progression of a performance based on operation, by a human player, on a performance operator unit 5, and for automatically generating tones on the basis of pre-created performance information sequentially supplied in accordance with a performance progression. Further, during execution of the above-mentioned tone synthesis function, the electronic musical instrument selects, for a sustain portion (also called "body portion") of a tone where the tone lasts relatively stably, an original waveform sample data set (hereinafter referred to simply as "waveform data set") to be next used on the basis of a dynamics value and pitch bend value (pitch information) included in the performance information and synthesizes a tone in accordance with the selected waveform data set, so that a tone of a rendition style, involving at least a timewise tone color variation or pitch variation, such as a vibrato rendition style or pitch bend rendition style in particular, can be reproduced with a high quality as a tone of the sustain portion). Such tone synthesis processing for a sustain portion will be later described in detail.

Although the electronic musical instrument employing the tone synthesis apparatus to be described below may include other hardware components than those described here, it will hereinafter be described in relation to a case where only necessary minimum resources are used. The electronic musical instrument will be described hereinbelow as employing a tone generator that uses a tone waveform control technique called "AEM (Articulation Element Modeling)" (so-called "AEM tone generator"). The AEM technique is intended to perform realistic reproduction and reproduction control of various rendition styles etc. faithfully expressing tone color variations based on various rendition styles or various types of articulation peculiar to various natural musical instruments, by prestoring, as waveform data corresponding to rendition styles peculiar to various musical instruments, entire waveforms corresponding to various rendition styles (hereinafter referred to as "rendition style modules") in partial sections or portions, such as an attack portion, release portion, sustain portion or joint portion, etc. of each individual tone and then time-serially combining a plurality of the prestored rendition style modules to thereby form one or more successive tones.

The electronic musical instrument shown in FIG. 1 is implemented using a computer, where various tone synthesis processing (such as "sustain portion synthesis processing" of FIG. 4) for realizing the above-mentioned tone synthesis function is carried out by the computer executing respective predetermined programs (software). Of course, these processing may be implemented by microprograms to be executed by a DSP (Digital Signal Processor), rather than by such computer software. Alternatively, the processing may be implemented by a dedicated hardware apparatus having discrete circuits or integrated or large-scale integrated circuit incorporated therein.

In the electronic musical instrument of FIG. 1, various operations are carried out under control of a microcomputer including a microprocessor unit (CPU) 1, a read-only memory (ROM) 2 and a random access memory (RAM) 3. The CPU 1 controls behavior of the entire electronic musical instrument. To the CPU 1 are connected, via a communication bus (e.g., data and address bus) 1D, a ROM 2, RAM 3, external storage device 4, performance operator unit 5, panel operator unit 6, display device 7, tone generator 8 and interface 9. Also connected to the CPU 1 is a timer 1A for counting various times, for example, to signal interrupt timing for timer interrupt processes. Namely, the timer 1A generates tempo clock pulses for counting a time interval and setting a performance tempo with which to automatically perform a music piece in accordance with given performance information. The frequency of the tempo clock pulses is adjustable, for example, via a tempo-setting switch of the panel operator unit 6. Such tempo clock pulses generated by the timer 1A are given to the CPU 1 as processing timing instructions or as interrupt instructions. The CPU 1 carries out various processes in accordance with such instructions.

The ROM 2 stores therein various programs to be executed by the CPU 1 and also stores therein, as a waveform memory, various data, such as waveform data corresponding to rendition styles peculiar to various musical instruments (particularly, vibrato and pitch bend rendition styles involving time-wise pitch variations and tone color variations). The RAM 3 is used as a working memory for temporarily storing various data generated as the CPU 1 executes predetermined programs, and as a memory for storing a currently-executed program and data related to the currently-executed program. Predetermined address regions of the RAM 3 are allocated to various functions and used as various registers, flags, tables, memories, etc. The external storage device 4 is provided for storing various data, such as performance information to be used as a basis of an automatic performance and waveform data corresponding to rendition styles, and various control programs, such as the "sustain portion synthesis processing" (see FIG. 4) to be executed or referred to by the CPU 1. Where a particular control program is not prestored in the ROM 2, the control program may be prestored in the external storage device (e.g., hard disk device) 4, so that, by reading the control program from the external storage device 4 into the RAM 3, the CPU 1 is allowed to operate in exactly the same way as in the case where the particular control program is stored in the ROM 2. This arrangement greatly facilitates version upgrade of the control program, addition of a new control program, etc. The external storage device 4 may comprise any of various removable-type external recording media other than the hard disk (HD), such as a flexible disk (FD), compact disk (CD), magneto-optical disk (MO) and digital versatile disk (DVD). Alternatively, the external storage device 4 may comprise a semiconductor memory.

The performance operator unit 5 is, for example, in the form of a keyboard including a plurality of keys operable to select pitches of tones to be generated and key switches provided in corresponding relation to the keys. This performance operator unit 5 can be used not only for a manual tone performance based on manual playing operation by a human player, but also as input means for selecting desired prestored performance information to be automatically performed. It should also be obvious that the performance operator unit 5 may be other than the keyboard type, such as a neck-like operator unit having tone-pitch-selecting strings provided thereon. The panel operator unit 6 includes various operators, such as performance information selecting switches for selecting desired performance information to be automatically performed and setting switches for setting various performance parameters, such as a tone color and effect to be used for a performance. Needless to say, the panel operator unit 6 may also include a numeric keypad for inputting numerical value data to select, set and control tone pitches, colors, effects, etc., a keyboard for inputting text or character data, a mouse for operating a pointer to designate a desired position on any of various screens displayed on the display device 7, and various other operators. For example, the display device 7 comprises a liquid crystal display (LCD), CRT (Cathode Ray Tube) and/or the like, which visually displays not only various screens in response to operation of the corresponding switches but also various information, such as performance information and waveform data, and controlling states of the CPU 1. The human player can readily set various performance parameters to be used for a performance, select a music piece to be automatically performed and perform various other desired operation, with reference to the various information displayed on the display device 7.

The tone generator 8, which is capable of simultaneously generating tone signals in a plurality of tone generation channels, receives performance information supplied via the communication bus 1D and synthesizes tones and generates tone signals on the basis of the received performance information. Namely, as waveform data corresponding to dynamics information and pitch bend information included in performance information are read out from the ROM 2 or external storage device 4, the read-out waveform data are delivered via the bus 1D to the tone generator 8 and buffered as necessary. Then, the tone generator 8 outputs the buffered waveform data at a predetermined output sampling frequency. Tone signals generated by the tone generator 8 are subjected to predetermined digital processing performed by a not-shown effect circuit (e.g., DSP (Digital Signal Processor)), and the tone signals having undergone the digital processing are then supplied to a sound system 8A for audible reproduction or sounding.

The interface 9, which is, for example, a MIDI interface or communication interface, is provided for communicating various information between the electronic musical instrument and external performance information generating equipment (not shown). The MIDI interface functions to input performance information of the MIDI standard from the external performance information generating equipment (in this case, other MIDI equipment or the like) to the electronic musical instrument or output performance information of the MIDI standard from the electronic musical instrument to other MIDI equipment or the like. The other MIDI equipment may be of any desired type (or operating type), such as the keyboard type, guitar type, wind instrument type, percussion instrument type or gesture type, as long as it can generate performance information of the MIDI format in response to operation by a user of the equipment. The communication interface is connected to a wired or wireless communication network (not shown), such as a LAN, Internet or telephone line network, via which the communication interface is connected to the external performance information generating equipment (in this case, server computer). Thus, the communication interface functions to input various information, such as a control program and performance information, from the server computer to the electronic musical instrument. Namely, the communication interface is used to download various information, such as a particular control program and performance information, from the server computer in a case where the information, such as a particular control program and performance information. is not stored in the ROM 2, external storage device 4 or the like. In such a case, the electronic musical instrument, which is a "client", sends a command to request the server computer to download the information, such as a particular control program and performance information, by way of the communication interface and communication network. In response to the command from the client, the server computer delivers the requested information to the electronic musical instrument via the communication network. The electronic musical instrument receives the information from the server computer via the communication interface and stores it into the external storage device 4 or the like. In this way, the necessary downloading of the information is completed.

Note that, in the case where the interface 9 is in the form of a MIDI interface, the MIDI interface may be implemented by a general-purpose interface rather than a dedicated MIDI interface, such as RS232-C, USB (Universal Serial Bus) or IEEE1394, in which case other data than MIDI event data may be communicated at the same time. In the case where such a general-purpose interface as noted above is used as the MIDI interface, the other MIDI equipment connected with the electronic musical instrument may be designed to communicate other data than MIDI event data. Of course, the performance information handled in the present invention may be of any other data format than the MIDI format, in which case the MIDI interface and other MIDI equipment are constructed in conformity with the data format used.

Figure 2:
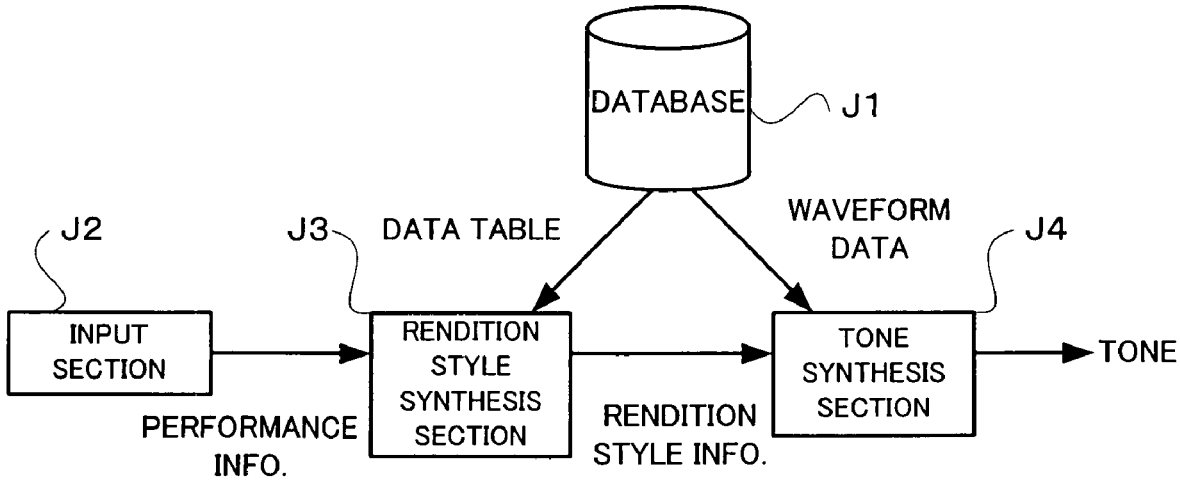
FIG. 2 is a functional block diagram explanatory of tone synthesizing functions.

The electronic musical instrument shown in FIG. 1 is equipped with the tone synthesis function capable of successively generating tones on the basis of performance information generated in response to operation, by the human operator, of the performance operator unit 5 or performance information of the SMF (Standard MIDI File) or the like prepared in advance. Also, during execution of the tone synthesis function, the electronic musical instrument selects a set of waveform data, which is to be next used for a sustain portion, on the basis of dynamics information included in performance information supplied in accordance with a performance progression based on operation, by the human operator, of the performance operator unit 5 (or performance information supplied sequentially from a sequencer or the like), and then it synthesizes a tone in accordance with the selected waveform data. So, the following paragraph outlines the tone synthesis function of the electronic musical instrument shown in FIG. 1, with reference to FIG. 2. FIG. 2 is a functional block diagram explanatory of the tone synthesis function of the electronic musical instrument, where arrows indicate flows of data.

Once the execution of the tone synthesis function is started, performance information is sequentially supplied from an input section J2 to a rendition style synthesis section J3 in accordance with a performance progression. The input section J2 includes, for example, the performance operator unit 5 that generates performance information in response to performance operation by the human operator or player, and a sequencer (not shown) that supplies, in accordance with a performance progression, performance information prestored in the ROM 2 or the like. The performance information supplied from such an input section J2 includes at least performance event data, such as note-on event data and note-off event data (these event data will hereinafter be generically referred to as "note information"), and control data, such as dynamics information and pitch bend information. Namely, examples of the dynamics information and pitch bend information input; via the input section J2 include information generated in real time on the basis of performance operation on the performance operator unit 5 (e.g., after-touch sensor output data generated in response to depression of a key, pitch bend change data generated in response to operation of an operator like a pitch bend wheel, etc.).

Upon receipt of performance event data, control data, etc., the rendition style synthesis section J3 generates "rendition style information", including various information necessary for tone synthesis, by, for example, segmenting a tone, corresponding to note information, into partial sections or portions, such as an attack portion, sustain portion (or body portion) and release portion, identifying a start time of the sustain portion and generating information of a gain and pitch using the received control data. In generating "rendition style information" for synthesis of a sustain portion of a tone in the instant embodiment, the rendition style synthesis section J3 selects, from among a multiplicity of "units" (see FIG. 3) to be applied to the sustain portion, a particular unit corresponding to the input dynamics information by referencing, for example, a data table located in a database (waveform memory) J1. The rendition style synthesis section J3 also selects, from among a plurality of waveform data sets defined in the selected unit, one waveform data set corresponding to the input pitch bend information.

Then, the rendition style synthesis section J3 sets, in accordance with the input dynamics information and pitch bend information, a "waveform switching time" (crossfade time period), over which crossfade synthesis is to be performed to smoothly connected the selected waveform data set and another waveform data set immediately preceding the selected waveform data set. In this manner, the rendition style synthesis section J3 generates "rendition style information" that includes a unique waveform number (ID) assigned to the waveform switching time set and the "waveform switching time" set in the aforementioned manner. Such tone synthesis processing for a sustain portion will be later described in greater detail. Tone synthesis section J4 reads out, on the basis of the "rendition style information" generated by the rendition style synthesis section J3, waveform data etc. from the database J1 and then performs tone synthesis. Namely, the tone synthesis section J4 synthesizes a tone of the sustain portion in accordance with the "rendition style information" by switching between successive waveform data sets while modifying the waveform switching time. In this way, the tone synthesis section J4 can output a tone based on a rendition style involving a timewise tone color variation.

Figure 3:
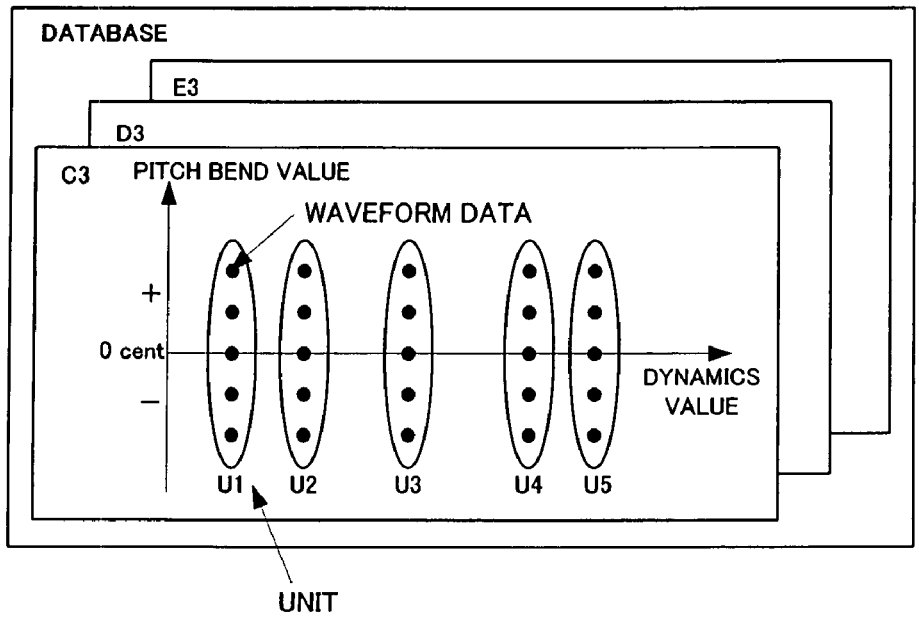
FIG. 3 is a conceptual diagram showing an example data structure of waveform data sets stored in a database for application to sustain portions.

Next, with reference to FIG. 3, a description will be given about a data structure of some of the waveform data sets stored in the above-mentioned database (waveform memory) J1 for application to sustain portions. Namely, FIG. 3 is a conceptual diagram showing the data structure of the waveform data sets stored in database J1 for application to sustain portions, where the vertical axis represents pitch event values indicative of pitch shift amounts from a zero pitch shift (0 cent) point while the horizontal axis represents dynamics values indicative of tone volume levels. In the figure, unique unit numbers "U1"-"U5" are indicated immediately below the corresponding units that are represented by vertically oriented ovals and one or more waveform data sets included (defined) in each of the units U1-U5 are represented by small black circles within the oval, for convenience of explanation. In the illustrated example of FIG. 3, the units U1-U5 each include five waveform data sets.

In the database J1, waveform data sets to be applied to sustain portions and data related to the waveform data sets are stored as a "unit". As illustrated in FIG. 3, the units U1-U5 are associated with different dynamics values, and one or more such units associated with different dynamics values are stored in the database J1 for each of different tone pitches (only C3", "D3" and "E3" are shown in the figure, for convenience). Assuming, for example, that, per nominal tone color (tone color of a piano, guitar or the like, i.e. tone color selectable by tone color information), five units associated with five dynamics values are stored for each of 35 different tone pitches (scale notes), the database J1 stores a total of 175 (35×5) units for the nominal tone color.

Each one of the units U1-U5, which corresponds to one dynamics value, includes a plurality of (five in the illustrated example) waveform data sets of different tone colors that correspond to different pitch shift amounts (e.g., in cents). The waveform data sets included in the individual units U1-U5 represent tone waveforms having different tone-color-related characteristics that differ among the units U1-U5, corresponding to different dynamics, regardless of the pitches. In storing waveform data sets, a plurality of partial waveforms (e.g., one-cycle partial waveforms), variously varying in tone color in accordance with rendition styles, are selected and taken out, from plural-cycle waveform data sets each covering one vibrato cycle (i.e., vibrato-imparted waveform data sets) performed with respective dynamics, and these selected waveform data are used (store) as a "unit". As a specific example, vibrato-imparted waveform data sets of partial waveforms, corresponding to a certain tone pitch (note) of a certain nominal tone color (e.g., saxophone tone color), corresponding to pitch shifts of a plurality of steps (e.g., 10 cents per step) in the range of −20 cents to +20 cents (but including a waveform data set with no pitch shift (zero cent)) and somewhat differing in tone color from one another, are used (store) as a "unit". Thus, as shown in FIG. 3, the instant embodiment is arranged to map data, as a two-dimensional matrix, in a storage region of the database J1 (e.g., external storage device 4) in such a manner that waveform data sets of a plurality of tone colors can be managed, per tone pitch (scale note), in accordance with the dynamics and pitch (pitch shift amount). In such a case, reference dynamics information and pitch bend information (pitch shift amounts) are stored, per unit U1-U5, in the database J1 as a group of additional data corresponding to the waveform data sets. In this way, the user is allowed to search for/select, from among the stored waveform data sets, a particular waveform data set corresponding to a designated input dynamics value and input pitch bend value. Further, in the instant embodiment, arrangements are made such that the group of additional data can be managed collectively as a "data table".

Each of the waveform data sets included in each of the units U1-U5 need not necessarily comprise data of a waveform of one cycle and may comprise data of a waveform of two or more cycles. Alternatively, the waveform data set may comprise data of a waveform of less than one cycle, such as one-half cycle, as well known in the art.

Whereas FIG. 3 shows the waveform data sets, included in each of the units U1-U5, as not being mapped so as to line up at uniform intervals in the dynamics direction, they may be mapped so as to line up at uniform intervals in the dynamics direction. Further, whereas FIG. 3 shows the waveform data sets, included in the individual units U1-U5, as being mapped so as to line up at uniform intervals in the pitch direction, they may be mapped so as not to line up at uniform intervals in the pitch direction. To that end, a plurality of partial waveform data sets, variously varying in tone color, in a set of waveform data of plural waveform cycles may be selected and stored. Namely, partial waveform data sets may be selected and stored by differentiating, among the units U1-U5, the number of cents per step within the predetermined range with the no pitch shift (zero cent) as the reference, e.g., 10 cents per step for the unit U1, 5 cent per step for the unit U2 and so on. In that case, the reference pitch shift amount may be set at a desired amount other than the "no pitch shift (zero cent)" amount.

Note that the above-mentioned units may be stored in correspondence with a group of two or more pitches (e.g., C3 and C#3), rather than being stored per pitch (scale note).

Figure 4:
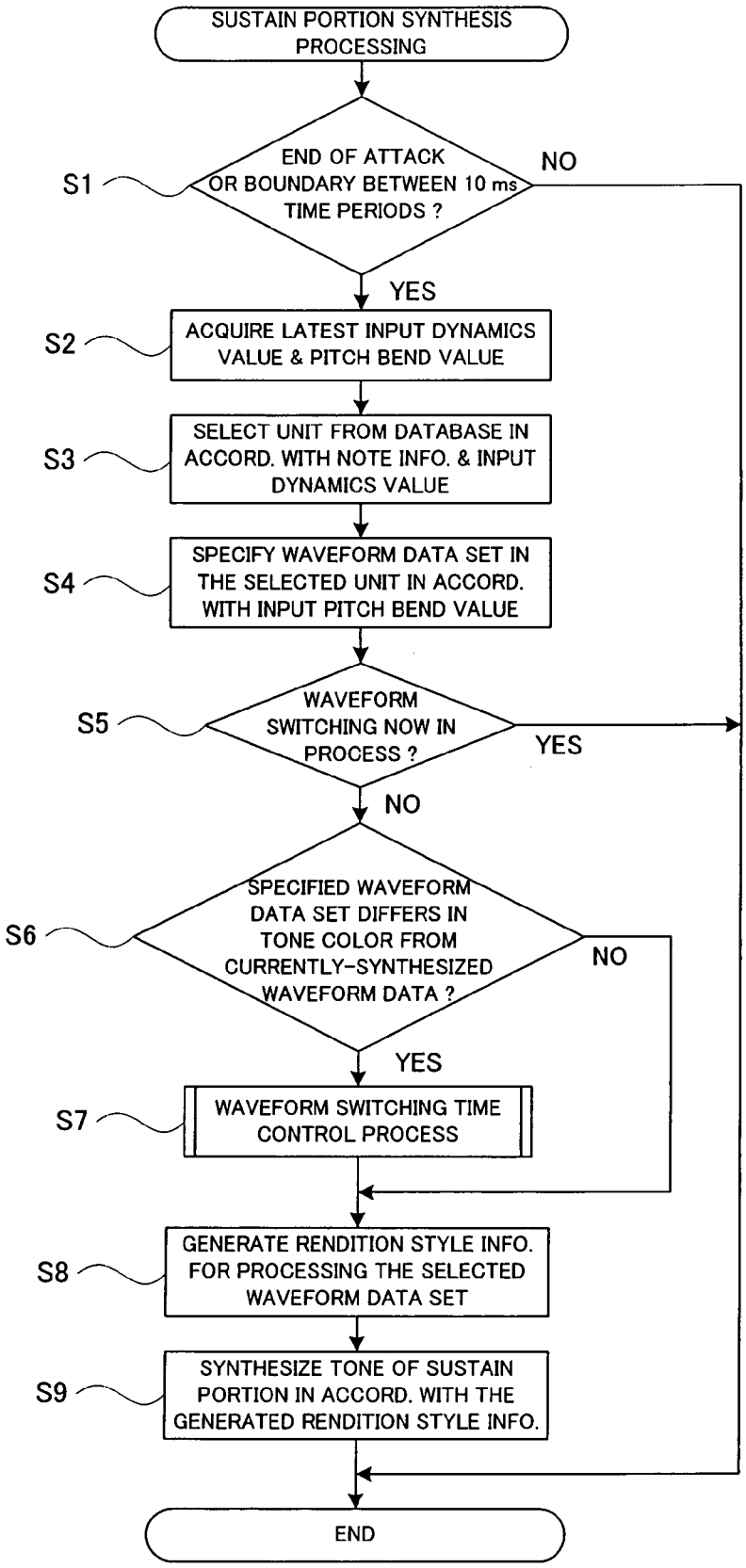
FIG. 4 is a flow chart showing an example of a specific operational sequence of sustain portion synthesis processing.

Next, a description will be given about the "sustain portion synthesis processing" for synthesizing a tone waveform of a sustain portion. FIG. 4 is a flow chart showing an example of a specific operational sequence of the "sustain portion synthesis processing", which is interrupt processing performed, e.g. every one ms (millisecond), by the CPU 1 of the electronic musical instrument in accordance with the outputs from the timer 1A activated in response to a start of a performance. The "sustain portion synthesis processing" is performed to synthesize a sustain portion of a tone, during the course of sounding of the tone, with characteristics such that the pitch and tone color vary over time delicately or complexly on the basis of a vibrato rendition style, pitch bend rendition style or the like. Waveform of an attack portion is synthesized by separate attack portion synthesis processing (not shown), and this "sustain portion synthesis processing" is performed following the attack portion synthesis processing. In the "sustain portion synthesis processing", a pitch (note) of a tone to be generated is designated by note information, and pitch bend information is input in real time in response to operation, by the human player, of a pitch operation means, such as a pitch bend wheel. The instant embodiment uses, as the note-on information, information stored in the RAM 3 in response to a note-on event of the tone in question, and uses, as the dynamics information and pitch bend information, information stored, by the rendition synthesis section J3, in the RAM 3 as the latest dynamics and pitch bend values in response to operation of operators for inputting dynamics and pitch bend information.

At step S1 of the sustain portion synthesis processing, a determination is made as to whether a waveform of an attack portion currently being synthesized has reached the end of the attack portion or whether timing corresponding to a boundary between predetermined time periods (e.g., 10 ms time periods) has arrived after the end of the attack portion. If the waveform currently being synthesized has not yet reached the end of the attack portion or the timing corresponding to a boundary between the predetermined time periods (e.g., 10 ms time periods) has not yet arrived after the end of the attack portion (NO determination at step S1), the sustain portion synthesis processing is brought to an end and will not be performed till next interrupt timing. Namely, before the timing corresponding to the end of the attack portion is reached, tone synthesis of the attack portion is performed on the basis of waveform data of an attack portion, and the sustain portion synthesis processing is still not performed substantively. Similarly, for a position of a sustain portion that does not coincide with the timing corresponding to a boundary between the predetermined time periods (e.g., 10 ms time periods), the processing waits for arrival of the next interrupt timing (i.e., one ms later) without performing an operation for specifying a waveform data set to be next used (see an operation of step S4). Therefore, in such a time period from the current interrupt timing to the next interrupt timing, no switching is effected between waveform data sets in response to input dynamics and input pitch bend values.

If, on the other hand, the waveform currently being synthesized has reached the end of the attack portion or the timing corresponding to a boundary between the predetermined time periods (e.g., 10 ms time periods) has arrived after the end of the attack portion (YES determination at step S1), the latest stored input dynamics value and input pitch bend value are acquired at step S2. At next step S3, the database is referenced, in accordance with previously-acquired note information and the acquired input dynamics value and input pitch bend value, to select a corresponding one of the units. Such a unit selection based on the input dynamics value will be later described with reference to FIG. 8. At step S4, one waveform data set is specified, from the waveform data sets in the selected unit, in accordance with the acquired input pitch bend value.

At step S5, a further determination is made as to whether a waveform switching operation is now in progress, i.e. whether tone synthesis currently being performed is based on crossfade synthesis between two adjoining waveform data sets. If waveform switching is now in progress (YES determination at step S5), the sustain portion synthesis processing is brought to an end. Namely, if a tone is currently being synthesized with the waveform switching operation too performed concurrently, then switching to the waveform data set corresponding to the input dynamics value and input pitch bend value as described below is not effected. If, on the other hand, no waveform switching is now in progress, i.e. if a tone is currently being synthesized with one waveform set repetitively read out (NO determination at step S5), a further determination is made, at step S6, as to whether the waveform data set specified at step S4 above differs in tone color from the currently-synthesized waveform data. Note that the operation of step S5 may alternatively be performed immediately before step S2. If the waveform data set specified at step S4 above is identical in tone color to the currently-synthesized waveform data (NO determination at step S6), the processing jumps to step S8. If, on the other hand, the specified waveform data set differs in tone color from the currently-synthesized waveform data (YES determination at step S6), a "waveform switching time control process" is performed at step S7 as will be later described with reference to FIG. 5.

At step S8, rendition style information for processing the selected waveform data set is generated. Namely, not only a time position etc. of the selected waveform data set is determined, but also rendition style information for processing the selected waveform data set is generated on the basis of the input pitch bend information etc. Here, the processing of the selected waveform data set includes a pitch adjustment operation. For example, in a case where the waveform data set corresponding to the input pitch bend information does not agree with the pitch shift amount indicated by the pitch bend information, information for achieving the pitch shift amount indicated by the pitch bend information is generated by adjusting the generation pitch of the selected waveform data set. In this manner, necessary rendition style information is generated. Then, at step S9, a tone of the sustain portion is synthesized in accordance with the thus-generated rendition style information. At that time, crossfade synthesis is performed between two adjoining (i.e., preceding and succeeding) waveforms (in other words, switched-from and switched-to waveforms), to thereby permit smooth switching between the two waveforms.

The following paragraphs describe the "waveform switching time control process" carried out in the aforementioned "sustain portion synthesis processing" of FIG. 4. FIG. 5 is a flow chart showing an example operational sequence of the "waveform switching time control process".

At step S11 of the "waveform switching time control process", a determination is made as to whether the waveform switching in question is to another waveform data set included in the same unit as the currently-synthesized waveform data (but differing in tone color from the currently-synthesized waveform data), i.e. whether the specified (switched-to) waveform data set and the currently-synthesized waveform data belong to the same unit. If the input dynamics value has not varied during the current tone synthesis and the waveform switching in question is to another waveform data set included in the same unit (YES determination at step S11), the "waveform switching time" (crossfade time period) over which the crossfade synthesis is to be performed to smoothly interconnect the specified waveform data set and the waveform data set immediately preceding the specified waveform data set (i.e., succeeding and preceding waveform data sets), is set at 50 ms, and the thus-set "waveform switching time" (in this case, reference waveform switching time of 50 ms) is set into (i.e., as part of rendition style information at step S14. If, on the other hand, the input dynamics value has varied during the current tone synthesis and the waveform switching in question is not to another waveform data set included in the same unit, i.e. the waveform switching in question is to a waveform data set in another one of the units (NO determination at step S11), the process goes to step S12 in order to calculate an absolute value of a difference between the previous input dynamics value recorded or acquired, for example, 100 ms earlier than the current time point and the current input dynamics value acquired at the current time point at step S2 of FIG. 4. Then, with reference to a table of FIG. 6 or the like, a "waveform switching time" corresponding to the calculated absolute value is determined and the thus-determined "waveform switching time" is set into the rendition style information, at step S13.

Now, with reference to FIG. 6, a description will be given about the aforementioned table that is referenced in determining the "waveform switching time" on the basis of the absolute value of the difference between the previous input dynamics value acquired 100 ms earlier than the current time point and the current input dynamics value. FIG. 6 shows an example of such a table referenced in determining the "waveform switching time" on the basis of a dynamics value variation amount (i.e., the aforementioned absolute value (ΔD)). In a left section of the table shown in FIG. 6, there are shown example of the dynamics value variation amount (in the illustrated example, absolute value ΔD between the previous input dynamics value acquired 100 ms earlier than the current time point and the current input dynamics value), while, in a right section of the table shown in FIG. 6, there are shown examples of the waveform switching time to be applied to the example absolute values.

According to the table shown in FIG. 6, the waveform switching time is associated with "50 ms" when the absolute value of the difference between the previous input dynamics value acquired 100 ms earlier than the current time point and the current input dynamics value is in the range of "1-5 dB (decibel)". The instant embodiment uses "50 ms" as the reference waveform switching time, because "50 ms" has been conventionally known as a normal waveform switching time that not only permits a tone color variation with a good responsive ness in an ordinary performance but also is most suited to smoothly switch between adjoining waveforms in a balanced manner without causing the tone color variation to impart; a feeling of step-like unsmoothness. Here, the "ordinary performance" means a performance in which the dynamics varies mildly without varying too rapidly or too slowly. When the absolute value (ΔD) is "5 dB or over", i.e. in a case where there has been executed a performance with the dynamics varying rapidly and greatly within a short time, the waveform switching time is associated with "10 ms". The "10 ms" waveform switching time is a shorter time than the reference waveform switching time in an ordinary performance. Such a shortened waveform switching time allows switching between tone color variations to be completed earlier than that in an ordinary performance, which thereby allows the tone color variation to follow the dynamics value variation with an enhanced responsiveness or follow-up capability. Further, if the absolute value (ΔD) is "less than 1 dB", i.e. in a case where there has been executed a performance with the dynamics varying slowly and gradually over a long time, the waveform switching time is associated with "200 ms". The "200 ms" waveform switching time is a time longer than the reference waveform switching time in an ordinary performance. Such an extended waveform switching time allows the tone color variation switching to progress more slowly than that in an ordinary performance, so that a feeling of step-like unsmoothness that may be involved in the tone color variation can be reduced.

Of course, almost-continuous values of the waveform switching time may alternatively be associated with various absolute values (ΔD), instead of the stepwise values, such as "10 ms", "50 ms" and "200 ms", of the waveform switching time being associated with various absolute values (ΔD) with reference to the aforementioned table. One example of such an alternative is illustrated in FIG. 7. FIG. 7 is a conceptual diagram schematically showing continuous relationship between the waveform switching time and the dynamics value variation amount; (absolute value (ΔD)). In the illustrated example of FIG. 7, the waveform switching time is associated with "200 ms" when the absolute value (ΔD) is "less than 1 dB" and associated with "10 ms" when the absolute value (ΔD) is "5 dB or over", as in the example of FIG. 6. However, in the illustrated example of FIG. 7, the waveform switching time is continuously varied linearly (or in a desired curve although not specifically shown) within the range of 200 ms-10 ms when the absolute value (ΔD) is in the range of "1-5 dB", so as to be associated with various absolute values (ΔD). In this way, timing of the tone color variation responsive to the dynamics value variation can be controlled more finely than in the aforementioned case where stepwise values of the waveform switching time are associated various absolute values (ΔD). The foregoing settings of the waveform switching time are just illustrative, and the present invention is of course not so limited.

Namely, the above-described embodiment is arranged in such a manner that it calculates a difference between the previous input dynamics value acquired 100 ms earlier than the current time point and the current input dynamics value acquired at the current time point and the absolute value (ΔD) of the thus-calculated difference is used in determining a waveform switching time. However, the present invention is not so limited, and the calculated difference with a plus or minus (positive or negative) sign may be used so that, even for the same absolute value (ΔD), the waveform switching time is differentiated between the case where the calculated difference is a positive value (representing an increase of the dynamics as compared to that 100 ms earlier) and the case where the calculated difference is a positive value (representing a decrease of the dynamics as compared to that 100 ms earlier). Further, it is appropriate that the dynamics value, of which the aforementioned difference is to be calculated, be a dynamics value acquired "100 ms" (twice as long as the reference time "50 ms" that is empirically used as a balanced crossfade time period permitting a highly-responsive tone color variation in an ordinary performance and preventing the tone color variation from imparting a feeling of undesired step-like unsmoothness) earlier than the current time point. However, the present invention is of course not so limited.

Further, it should be appreciated that the dynamics value difference to be determined may be one between a dynamics value acquired a desired fixed time (not limited to 100 ms) earlier than the current time point and the current input dynamics value or may be one between a dynamics value acquired a desired variable time earlier than the current time point and the current input dynamics value.

Furthermore, whereas the instant embodiment has been described above as setting a waveform switching time in accordance with a dynamics value variation amount (e.g., the aforementioned absolute value (ΔD)), the present invention is not so limited. For example, the waveform switching time may be determined in accordance with a difference between a previous pitch acquired 100 ms earlier than the current time point and a pitch acquired at the current time point (i.e., in accordance with a pitch variation amount). The above-mentioned "pitch" is determined on the basis of the note (tone pitch) information included in the performance information and pitch bend value. In such a case, it is only necessary to modify the operation of step S12 of FIG. 5 so as to determine a difference between a pitch acquired 100 ms earlier than the current time point and a current pitch. In another alternative, the waveform switching time may be determined in accordance with both a dynamics value variation and a pitch variation over time.

Alternatively, for each of the units stored in the database, there may be prestored, in one data table, a representative dynamics value (e.g., average dynamics value of the waveform data sets included in the unit), in which case a difference between the representative dynamics value of a switched-from (or preceding) unit and the representative dynamics value of a specified switched-to (or succeeding) unit may be calculated to determine, on the basis of the calculated difference, a waveform switching time to be applied.

The table shown in FIG. 6 may be replaced with a table in which waveform switching times are stored in association with differences between unique unit numbers (U1, U2, . . . ) of the individual units stored in the database. When waveform switching is to be effected, a difference is calculated between the unit number of a switched-from (preceding) unit and the unit number of a specified switched-to (succeeding) unit, the table is referenced, on the basis of the calculated unit number difference, to determine a waveform switching time to be applied.

Figure 8A:
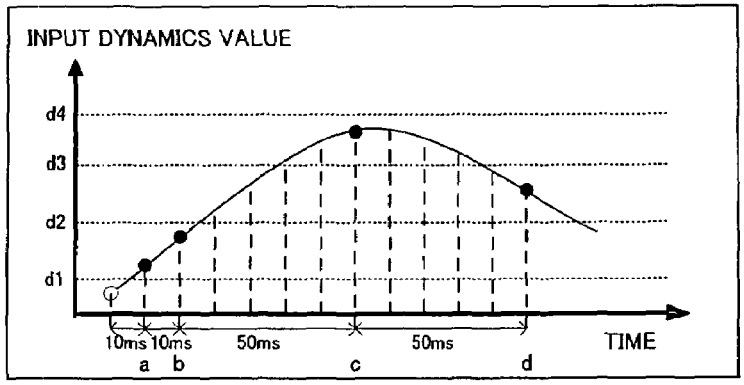
FIG. 8A is a diagram showing an example variation over time of an input dynamics value and FIG. 8B is a diagram explanatory of selection of a waveform data set.
Figure 8B:
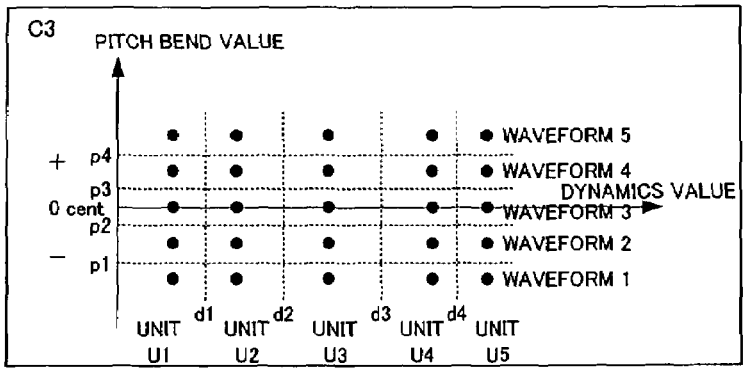
Figure 9A:
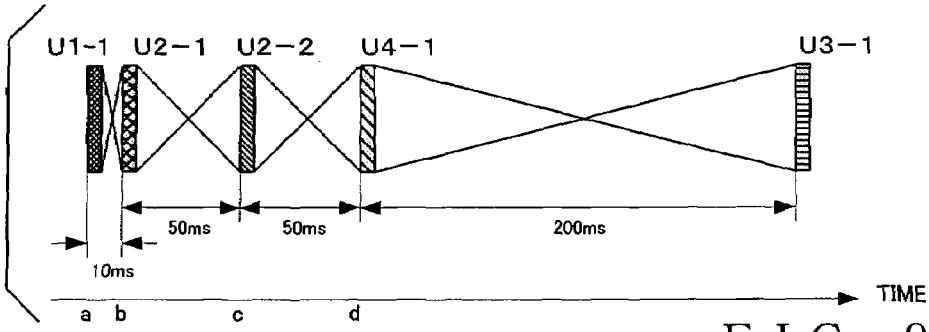
FIG. 9A is a diagram showing a time-serial combination of one-wave waveform data sets and FIG. 9B is a diagram showing a time-serial combination of plural-wave waveform data sets.
Figure 9B:
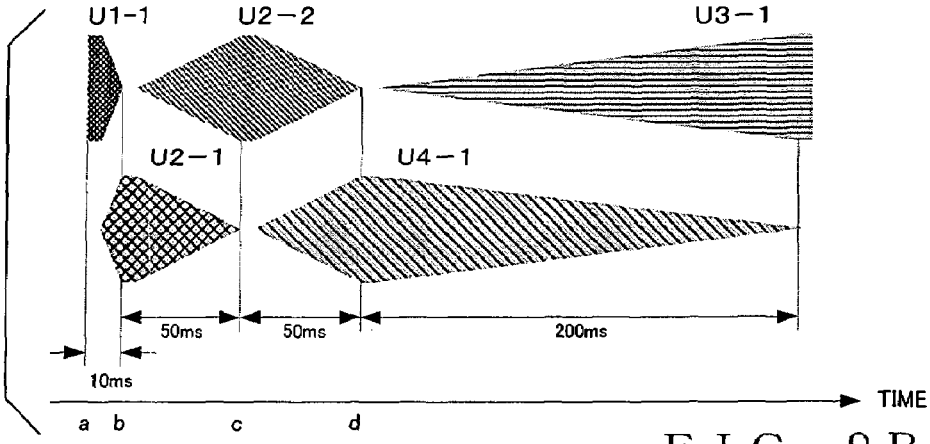

Next, with reference to FIGS. 8A, 8B, 9A and 9B, a further description will be given about the "sustain portion synthesis processing" of FIG. 4. FIGS. 8A and 8B are diagrams explanatory of selection of a unit and waveform data set in the "sustain portion synthesis processing" (see steps S3 and S4 of FIG. 4). More specifically, FIG. 8A is a diagram showing an example variation over time of the input dynamics values, where the vertical axis represents the input dynamics value while the horizontal axis represent the passage of time. FIG. 8B is a diagram explanatory of selection of a waveform data set, stored in the database, corresponding to the input dynamics value and input pitch bend value. FIG. 9 shows example time-serial combinations of waveform data sets selected in accordance with the input dynamics values and pitch bend values. More specifically, FIG. 9A is a diagram showing a time-serial combination of one-wave waveform data sets, while FIG. 9B is a diagram showing a time-serial combination of plural-wave waveform data sets. FIG. 9B shows, for the sake of convenience, adjoining waveform data sets are shown in two, upper and lower, rows so that fade-in and fade-out sections of the adjoining waveform data sets are not indicated in overlapping relation to each other. It is assumed here that a tone of the pitch "C3" is generated by the following sustain portion synthesis processing, and that there has already been acquired note information of the tone of the pitch "C3" to be generated. Let it also be assumed here that tone synthesis using "waveform data set 1" of the unit U1 is being repetitively performed prior to a time point a. Also note here that each waveform data set is indicated by a combination of the corresponding unit number (i.e., one of U1-U5) and waveform number (i.e., one of 1-5), such as "U1-1".

In a case where the time point a shown in FIG. 8A represents timing corresponding to the (trailing) end of an attack portion or timing corresponding to a boundary between predetermined time periods (e.g., 10 ms time periods), the latest input dynamics value and pitch bend value (i.e., latest inputs at that time point) are acquired. Then, one unit is selected, from among the units U1-U5 stored in the database in association with the tone pitch "C3", on the basis of the already-acquired note information of the tone pitch "C3" and the acquired input pitch bend value. In the illustrated example of FIG. 8B, the unit U1 is selected if the acquired input dynamics value is "smaller than d1 (predetermined threshold value)", the unit U2 is selected if the acquired input dynamics value is "equal to or greater than d1 but smaller than d2", the unit U3 if the acquired input dynamics value is "equal to or greater than d2 but smaller than d3", the unit U4 if the acquired input dynamics value is "equal to or greater than d3 but smaller than d4", and the unit U5 if the acquired input dynamics value is "equal to or greater than d4". In this case, the input dynamics value acquired at the time point a is "equal to or greater than d1 but smaller than d2", and thus, the unit U2 is selected at the time point a.

Following the aforementioned selection of the unit U2, one particular waveform data set is selected or specified, from among the waveform data sets (waveform 1-waveform 5) included in the selected unit U2, on the basis of the input pitch bend value acquired at the time point a. In the illustrated example of FIG. 8B, waveform 1 is selected if the acquired input pitch bend value is "smaller than p1 (predetermined threshold value)", waveform 2 is selected if the acquired input pitch bend value is "equal to or greater than p1 but smaller than p2", waveform 3 if the acquired input pitch bend value is "equal to or greater than p2 but smaller than p3", waveform 4 if the acquired input pitch bend value is "equal to or greater than p3 but smaller than p4", and waveform 5 if the acquired input pitch bend value is "equal to or greater than p4". Thus, if the input pitch bend value acquired at the time point a is "smaller than p1", waveform 1 (U2-1) is specified from among the waveforms of the selected unit U2.

When the current tone synthesis is not in the process of switching between waveforms, i.e. when the current tone synthesis is being performed by repetitively reading out the same waveform data set (e.g., waveform 1 of the unit U1), and if waveform 1 of the selected unit U2 differs in tone color from the preceding waveform (U1-1), the process for setting a waveform switching time is performed. If the preceding waveform (U1-1) and the specified waveform (U2-1) do not belong to the same unit (i.e., the waveform switching is to be effected between different ones of the units), and if the absolute value of the difference between the previous input dynamics value acquired 100 ms earlier than the time point a and the current input dynamics value acquired at the time point a is, for example, "5 dB or over", the waveform switching time is set at "10 ms" by reference to the table shown in FIG. 6. Then, waveform 1 of the unit U2 is repetitively read out to thereby generate a tone waveform of a sustain portion. At that time, the processing performs tone synthesis while smoothly switching between preceding waveform 1 of the unit U1 (U1-1) and succeeding waveform 1 of the selected unit U2 (U2-1) by performing crossfade synthesis between the two waveforms for the set 10 ms time. In the case where one-wave (one-cycle) waveform data sets are used, the set waveform switching time is applied as a crossfade time period for repetitively reading out the waveform data, but, in the case where plural-wave (one-cycle) waveform data sets are used, the set waveform switching time is applied as a crossfade time period for performing crossfade between the adjoining (preceding and succeeding) waveform data sets.

If a new input dynamics value has been acquired (i.e., the dynamics value has been updated) at a time point b that is 10 ms later than the preceding time point a, one of the units which corresponds to the acquired new input dynamics value is selected from the database. In the illustrated example, the new input dynamics value is "equal to or greater than d1 but smaller than d2", and thus, the unit U2 is selected at the time point b. Further, one of the waveform data sets of the selected unit which corresponds to an input pitch bend value acquired at the time point b is specified. If the acquired input pitch bend value is, for example, "equal to or greater than p1 but smaller than p2", waveform 2 (U2-2) is specified from the selected unit U2. Because the preceding waveform (U2-1) and the specified or succeeding waveform (U2-2) belong to the same unit (i.e., the waveform switching is to be effected here within the same unit), the waveform switching time is set at "50 ms" without the table of FIG. 6 being referenced (see step S14 of FIG. 5). Thus, the processing initiates tone synthesis while smoothly switching between preceding waveform 1 of the unit U2 (U2-1) and succeeding waveform 2 of the selected unit U2 (U2-2) by performing crossfade synthesis between the two waveforms for the set 50 ms time.

If a new input dynamics value and pitch bend value have been acquired (i.e., the dynamics value has been updated) at a next time point that is 10 ms later than the preceding time point b, neither the operation for selecting, from the database, one of the units which corresponds to the acquired new input dynamics value, nor the operation for specifying one of the waveform data sets of the selected unit which corresponds to the acquired new input pitch bend value is performed. Namely, these operations related to waveform switching are not performed because "50 ms" is currently set as the waveform switching time to be used for switching from the waveform U2-1, set at the time point b, to the waveform U2-2 and the switching between the two waveforms is still in progress when the 10 ms time has passed from the time point b (see the YES determination at step S5 of FIG. 4). Similarly, such waveform-switching-related operations are not performed at subsequent time points (not shown) that are 20 ms, 30 ms and 40 ms later than the time point b.

At a time point c 50 ms later than the time point b, the switching from the waveform U2-1, set at the time point b, to the waveform U2-2 is completed. If a new input dynamics value has been acquired (i.e., the dynamics value has been updated) at the time point c, one of the units which corresponds to the acquired new input dynamics value is selected from the database. In the illustrated example, the new input dynamics value acquired at the time point c is "equal to or greater than d3 but smaller than d4", and thus, the unit U4 is selected at the time point c. Further, if a new input pitch bend value acquired at the time point c is, for example, "smaller than p1", waveform 1 (U4-1) is specified from among the waveforms of the selected unit U4. Because the preceding waveform (U2-2) and the specified or succeeding waveform (U4-1) do not belong to the same unit (i.e., because the waveform switching is to be effected between different ones of the units), the waveform switching time is set at "50 ms" by reference to the table of FIG. 6. Then, the processing initiates tone synthesis while smoothly switching between preceding waveform 2 of the unit U2 (U2-2) and succeeding waveform 1 of the selected unit U4 (U4-1) by performing crossfade synthesis between the two waveforms for the set 50 ms time.

If a new input dynamics value has been acquired (i.e., the dynamics value has been updated) at a time point d which agrees with a boundary between the predetermined time periods (e.g., 10 ms time periods) following the end of the attack portion and at which the switching from the preceding waveform (U2-2) to the succeeding waveform (U4-1) is completed, one of the units which corresponds to the acquired new input dynamics value is selected from the database. In the illustrated example, the new input dynamics value acquired at the time point d is "equal to or greater than d2 but smaller than d3", and thus, the unit U3 is selected at the time point d. Further, if a new input pitch bend value acquired at the time point d is, for example, "smaller than p1", waveform 1 (U3-1) is specified from among the waveforms of the selected unit U3. Because the preceding waveform (U4-1) and the specified or succeeding waveform (U3-1) do not belong to the same unit (i.e., because the waveform switching is to be effected here between different ones of the units), the waveform switching time is set at "200 ms" by reference to the table of FIG. 6, if the absolute value of a difference between the dynamics value acquired 100 ms earlier than the time point a and the input dynamics value acquired at the time point a is less than "1 dB". Then, the processing initiates tone synthesis while smoothly switching between preceding waveform 1 of the unit U4 (U4-1) and succeeding waveform 1 of the selected unit U3 (U3-1) by performing crossfade synthesis between the two waveforms for the set 200 ms time.

Namely, according to the synthesis processing described above, generation of rendition style information corresponding to the sustain portion is performed at predetermined time intervals (10 ms intervals) during tone synthesis of the sustain portion started following the end of an attack portion. At that time, a waveform data set corresponding to the latest acquired input pitch bend value is specified from among a plurality of waveform data sets included in a unit corresponding to the latest acquired input dynamics value, and a tone is synthesized on the basis of the specified waveform data set in accordance with the generated rendition style information. Further, in performing crossfade synthesis between the preceding waveform data set and the succeeding specified waveform data set, the waveform switching time (crossfade time period), over which the crossfade synthesis is to be performed, is adjusted as necessary on the basis of a variation amount of the dynamics value and relationship between the preceding waveform data set and the succeeding specified waveform data set. Thus, when the dynamics has varied rapidly, the instant embodiment allows the tone color to vary with an enhanced responsiveness (follow-up capability). Further, when the dynamics has varied slowly over a long time period, the instant embodiment can effectively avoid step-like, unsmooth variation of the tone color. As a result, the instant embodiment can synthesize a high-quality tone faithfully reproducing a rendition style including a tone color variation over time in a sustain portion where the tone lasts in a stable condition.

The "sustain portion synthesis processing" of FIG. 4 has been described above as not performing the "waveform switching time control process" if the waveform switching operation is in progress when a waveform has been selected (YES determination at step S5 of FIG. 4). Alternatively, if the waveform switching operation is in progress when a waveform has been selected as determined at step S5 of FIG. 4, the crossfade synthesis corresponding to the currently-performed waveform switching may be accelerated so that the waveform switching can be completed in a shorter time than the initially-set waveform switching time. Such an alternative is advantageous in that it can even further enhance the tone color variation responsiveness to the dynamics value variation. The accelerated crossfade synthesis itself is already known in the art and will not be described in detail here.

Further, whereas the embodiment has been described above as modifying the waveform switching time in accordance with whether or not waveform switching is necessary, the present invention is not so limited. For example, a dynamics value variation amount may be determined every 10 ms to modify the waveform switching time in accordance with the dynamics value variation amount; such an arrangement too can enhance the tone color variation responsiveness relative to the dynamics value variation.

Furthermore, whereas the embodiment has been described above as specifying a waveform data set, corresponding to input pitch information, from among different-pitch waveform data sets of a unit associated with an input dynamics value, the present invention is not so limited. For example, waveform data sets of sustain portions may be prestored in association with dynamics values so that a waveform data set can be specified directly in accordance with an acquired dynamics value. However, as compared to this alternative where waveform data sets of sustain portions are prestored in association with dynamics values alone, the aforementioned inventive arrangements of the embodiment are advantageous in that they permit more fine variable control of tone characteristics because a waveform data set is specified in accordance with an acquired dynamics value and pitch information and a tone is synthesized with the waveform switching time, taken for a tone color variation, suitably modified on the basis of a dynamics value variation amount or pitch variation amount.

It should also be appreciated that the waveform data employed in the present invention may be of any desired type without being limited to those constructed as "rendition style modules" in correspondence with various rendition styles as described above. Further, the waveform data of the individual units may of course be either data that can be generated by merely reading out waveform sample data based on a suitable coding scheme, such as the PCM, DPCM or ADPCM, or data generated using any one of the various conventionally-known tone waveform synthesis methods, such as the harmonics synthesis operation, FM operation, AM operation, filter operation, formant synthesis operation and physical model tone generator methods. Namely, the tone generator 8 in the present invention may employ any of the known tone signal generation methods such as: the memory readout method where tone waveform sample value data stored in a waveform memory are sequentially read out in accordance with address data varying in response to the pitch of a tone to be generated;

the FM method where tone waveform sample value data are acquired by performing predetermined frequency modulation operations using the above-mentioned address data as phase angle parameter data; and the AM method where tone waveform sample value data are acquired by performing predetermined amplitude modulation operations using the above-mentioned address data as phase angle parameter data. Namely, the tone signal generation method employed in the tone generator 8 may be any one of the waveform memory method, FM method, physical model method, harmonics synthesis method, formant synthesis method, analog synthesizer method using a combination of VCO, VCF and VCA, analog simulation method, and the like. Further, instead of constructing the tone generator 8 using dedicated hardware, the tone generator circuitry 8 may be constructed using a combination of the DSP and microprograms or a combination of the CPU and software. Furthermore, a plurality of tone generation channels may be implemented either by using a same circuit on a time-divisional basis or by providing a separate dedicated circuit for each of the channels.

Further, the tone synthesis method in the above-described tone synthesis processing may be either the so-called playback method where existing performance information is acquired in advance prior to arrival of an originally-set performance time and a tone is synthesized by analyzing the thus-acquired performance information, or the real-time method where a tone is synthesized on the basis of performance information supplied in real time.

Furthermore, in the case where the above-described tone synthesis apparatus of the present invention is applied to an electronic musical instrument, the electronic musical instrument may be of any type other than the keyboard instrument type, such as a stringed, wind or percussion instrument type. The present invention is of course applicable not only to the type of electronic musical instrument where all of the performance operator unit, display, tone generator, etc. are incorporated together within the body of the electronic musical instrument, but also to another type of electronic musical instrument where the above-mentioned components are provided separately and interconnected via communication facilities such as a MIDI interface, various networks and/or the like. Further, the tone synthesis apparatus of the present invention may comprise a combination of a personal computer and application software, in which case various processing programs may be supplied to the tone synthesis apparatus from a storage medium, such as a magnetic disk, optical disk or semiconductor memory, or via a communication network. Furthermore, the tone synthesis apparatus of the present invention may be applied to automatic performance apparatus, such as karaoke apparatus and player pianos, game apparatus, and portable communication terminals, such as portable telephones. Further, in the case where the tone synthesis apparatus of the present invention is applied to a portable communication terminal, part of the functions of the portable communication terminal may be performed by a server computer so that the necessary functions can be performed cooperatively by the portable communication terminal and server computer. Namely, the tone synthesis apparatus of the present invention may be arranged in any desired manner as long as it can use predetermined software or hardware, arranged in accordance with the basic principles of the present invention, to synthesize a tone while appropriately switching, in accordance with an input dynamics values, input pitch bend value, etc., between units stored in the database and waveform data sets included in the units.

What is claimed is:

1. A tone synthesis apparatus comprising:

a storage section that stores therein a plurality of waveforms for sustain tones in association with dynamics values;

an acquisition section that, when a sustain tone is to be generated, acquires, in accordance with passage of time, a dynamics value for controlling a volume of the sustain tone to be generated;

a waveform selection section that selects a waveform corresponding to the dynamics value, acquired by said acquisition section, from among the waveforms stored in said storage section;

a tone signal synthesis section that synthesizes a tone signal using the waveform selected from said storage section in correspondence with the acquired dynamics value, said tone signal synthesis section performing crossfade synthesis between the waveforms successively selected from said storage section; and a determination section that determines a variation amount over time of the acquired dynamics value and variably sets, in accordance with the variation amount, a waveform switching time over which the crossfade synthesis is to be performed.

2. A tone synthesis apparatus as claimed in claim 1 wherein said determination section sets the waveform switching time to a predetermined reference time when the variation amount of the dynamics value is within a predetermined range, sets the waveform switching time to a time shorter than the reference time when the variation amount of the dynamics value is greater than the predetermined rang, and sets the waveform switching time to a time longer than the reference time when the variation amount of the dynamics value is smaller than the predetermined range.

3. A tone synthesis apparatus as claimed in claim 1 wherein said determination section sets the waveform switching time in accordance with the variation amount of the dynamics value with reference to a predetermined table.

4. A tone synthesis apparatus as claimed in claim 1 wherein said determination section sets the waveform switching time in accordance with an absolute value of the variation amount over time of the dynamics value.

5. A tone synthesis apparatus as claimed in claim 1 wherein said determination section sets the waveform switching time in accordance with a value of the variation amount over time of the dynamics value and a positive/negative sign of the value of the variation amount.

6. A tone synthesis apparatus comprising:

a storage section that stores therein a plurality of units, each including a plurality of waveforms corresponding to different pitches, in association with dynamics values;

an acquisition section that acquires, in accordance with passage of time, a dynamics value for controlling a tone to be generated and pitch information for controlling a pitch of the tone to be generated;

a waveform selection section that selects a unit corresponding to the dynamics value, acquired by said acquisition section, from among the units stored in said storage section and selects a waveform corresponding to the pitch information, acquired by said acquisition section, from among the waveforms included in the selected unit;

a tone signal synthesis section that synthesizes a tone signal using the waveform selected from said storage section in correspondence with the acquired dynamics value and pitch information, said tone signal synthesis section performing crossfade synthesis between the waveforms successively selected from said storage section; and a determination section that determines variation amounts over time of at least one of the acquired dynamics value and pitch information and variably sets, in accordance with the variation amounts, a waveform switching time over which the crossfade synthesis is to be performed.

7. A tone synthesis apparatus as claimed in claim 6 wherein said determination section sets the waveform switching time to a predetermined reference time when the variation amount of said at least one of the dynamics value and pitch information is within a predetermined range, sets the waveform switching time to a time shorter than the reference time when the variation amount of the dynamics value is greater than the predetermined rang, and sets the waveform switching time to a time longer than the reference time when the variation amount of the dynamics value is smaller than the predetermined range.

8. A tone synthesis apparatus as claimed in claim 6 wherein said determination section sets the waveform switching time in accordance with the variation amount of said at least one of the dynamics value and pitch information with reference to a predetermined table.

9. A tone synthesis apparatus as claimed in claim 6 wherein said determination section sets the waveform switching time in accordance with an absolute value of the variation amount over time of said at least one of the dynamics value and pitch information.

10. A tone synthesis apparatus as claimed in claim 6 wherein said determination section sets the waveform switching time in accordance with a value of the variation amount over time of said at least one of the dynamics value and pitch information and a positive/negative sign of the value of the variation amount.

11. A method for synthesizing a tone using a storage section that stores therein a plurality of waveforms for sustain tones in association with dynamics values, said method comprising:

an acquisition step of, when a sustain tone is to be generated, acquiring, in accordance with passage of time, a dynamics value for controlling a volume of the sustain tone to be generated;

a step of selecting a waveform corresponding to the dynamics value, acquired by said acquisition step, from among the waveforms stored in the storage section;

a tone signal synthesis step of synthesizing a tone signal using the waveform selected from the storage section in correspondence with the acquired dynamics value, said tone signal synthesis step performing crossfade synthesis between the waveforms successively selected from the storage section; and a step of determining a variation amount over time of the acquired dynamics value and variably setting, in accordance with the variation amount, a waveform switching time over which the crossfade synthesis is to be performed.

12. A method for synthesizing a tone using a storage section that stores therein a plurality of units, each including a plurality of waveforms corresponding to different pitches, in association with dynamics values, said method comprising:

an acquisition step of acquiring, in accordance with passage of time, a dynamics value for controlling a tone to be generated and pitch information for controlling a pitch of the tone to be generated;

a step of selecting a unit corresponding to the dynamics value, acquired by said acquisition step, from among the units stored in the storage section and selecting a waveform corresponding to the pitch information, acquired by said acquisition step, from among the waveforms included in the selected unit;

a tone signal synthesis step of synthesizing a tone signal using the waveform selected from the storage section in correspondence with the acquired dynamics value and pitch information, said tone signal synthesis step performing crossfade synthesis between the waveforms successively selected from the storage section; and a step of determining variation amounts over time of at least one of the acquired dynamics value and pitch information and variably setting, in accordance with the variation amounts, a waveform switching time over which the crossfade synthesis is to be performed.

13. A computer-readable storage medium containing a program for causing a computer to perform a tone synthesis procedure using a storage section that stores therein a plurality of waveforms for sustain tones in association with dynamics values, said tone synthesis procedure comprising:

an acquisition step of, when a sustain tone is to be generated, acquiring, in accordance with passage of time, a dynamics value for controlling a volume of the sustain tone to be generated;

a step of selecting a waveform corresponding to the dynamics value, acquired by said acquisition step, from among the waveforms stored in the storage section;

a tone signal synthesis step of synthesizing a tone signal using the waveform selected from the storage section in correspondence with the acquired dynamics value, said tone signal synthesis step performing crossfade synthesis between the waveforms successively selected from the storage section; and a step of determining a variation amount over time of the acquired dynamics value and variably setting, in accordance with the variation amount, a waveform switching time over which the crossfade synthesis is to be performed.

14. A computer-readable storage medium containing a program for causing a computer to perform a tone synthesis procedure using a storage section that using a storage section that stores therein a plurality of units, each including a plurality of waveforms corresponding to different pitches, in association with dynamics values, said tone synthesis procedure comprising:

an acquisition step of acquiring, in accordance with passage of time, a dynamics value for controlling a tone to be generated and pitch information for controlling a pitch of the tone to be generated;

a step of selecting a unit corresponding to the dynamics value, acquired by said acquisition step, from among the units stored in the storage section and selecting a waveform corresponding to the pitch information, acquired by said acquisition step, from among the waveforms included in the selected unit;

a tone signal synthesis step of synthesizing a tone signal using the waveform selected from the storage section in correspondence with the acquired dynamics value and pitch information, said tone signal synthesis step performing crossfade synthesis between the waveforms successively selected from the storage section; and a step of determining variation amounts over time of at least one of the acquired dynamics value and pitch information and variably setting, in accordance with the variation amounts, a waveform switching time over which the crossfade synthesis is to be performed.

* * * * *